United States Patent [19]

Parsons et al.

[11] Patent Number: 5,059,953

[45] Date of Patent: Oct. 22, 1991

[54] INFRARED OVERHEAT AND FIRE DETECTION SYSTEM

[75] Inventors: Michael L. Parsons, San Dimas; Peter L. Hutchins, Roland Heights; Yeong-Jeng V. Tseng, Phillips Ranch, all of Calif.

[73] Assignee: Pacific Scientific Company, Duarte, Calif.

[21] Appl. No.: 507,656

[22] Filed: Apr. 10, 1990

[51] Int. Cl.[5] ..... G08B 17/12

[52] U.S. Cl. ..... 340/578; 250/342; 250/353; 318/490; 340/511; 340/515; 340/584

[58] Field of Search ..... 340/577-578, 340/584, 515, 518, 567, 825.16, 511; 250/334, 338.1, 338.3, 342, 347, 353; 350/274, 486, 600, 409; 364/557; 318/490

[56] References Cited

U.S. PATENT DOCUMENTS 4,749,862 6/1988 Yoshida et al. ..... 250/342

4,769,545 9/1988 Fraden ..... 250/353

*Primary Examiner*—Glen R. Swann, III

*Assistant Examiner*—Thomas J. Mullen, Jr.

*Attorney, Agent, or Firm*—Knobbe, Martens, Olson & Bear

[57] ABSTRACT

A system for detecting an overheat condition in aircraft preferably includes two control units each connected to eight thermal imaging modules. The thermal imaging modules monitor the cargo by for an overheat condition and if any module detects an overheat condition, the control unit verifies the overheat condition and then triggers an alarm. The control units execute routines to monitor and test their operational status and that of each thermal imaging module. The control units are connected to the aircraft electronics to indicate the location of an overheat condition or any malfunctioning control units and thermal imaging modules. The thermal imaging modules are identical to each other and include an infrared detector, a rotating optical assembly, threshold circuitry and a motor. The optical assembly is rotated by the motor to provide the detector with a conical field of view. The optical assembly focuses the radiation in the cargo bay on the infrared detector. If the infrared detector measures a radiation level equal or greater than that of a fire, the threshold circuitry outputs an overheat signal to the control unit. The thermal imaging module also includes a thermal switch that will trigger an overheat signal if the temperature of the module itself is above a specified temperature.

38 Claims, 6 Drawing Sheets

7
40
39
35
34
33
32
31
237
236
235
234
233
232
231
230
50
7

40
39
35
34
33
32
31
237
235
233
231
50

INFRARED OVERHEAT AND FIRE DETECTION SYSTEM

BACKGROUND OF THE INVENTION

1. Field of the Invention

The present invention generally relates to fire detection and suppression systems, and particularly to fire detection systems for aircraft. More particularly, the present invention relates to aircraft fire detection systems that detect the presence of fire or an overheat condition by sensing infrared radiation.

2. Description of the Related Art

It is known to place fire detection systems in aircraft to alert the pilot and crew members to any potentially hazardous overheat or fire conditions. The fire detection systems currently employed even include sensors located in the cargo bay. However, fire detection systems known in the prior art have several serious shortcomings such as a tendency for false alarms. For example, the fire detection systems currently being used in commercial aircraft employ sensors that detect smoke to determine whether a fire is present. The smoke detectors presently used in aircraft cargo bays have reliability problems arising from their construction and operation that results in false alarms which have caused the aircraft to be diverted from use for service. Smoke detectors are also known to be overly sensitive and easily triggered by cigarette smoke or the lighting of a match. This, in turn affects the reliability of the entire aircraft.

Another problem with current fire detectors is the response time. Fires in cargo bays of aircraft pose a particular problem for fire detectors that detect fire by the presence of smoke. The FAA requires that all cargo be placed in covered containers. If a fire begins in one of these containers, the smoke is often trapped in the container and cannot immediately escape to trigger the alarm. Only after the fire has broken through the container and grown much larger will smoke-based fire detection systems be triggered. Thus, there is a substantial delay between the time the fire begins and the activation of the detection system to alert the crew and pilot to the presence of fire. This delay in detection time is heightened by the slow response of smoke sensors used to detect the presence of fire.

Another shortcoming of the prior art is the amount of information provided to the pilot and crew. Most fire detection systems presently available only alert the crew to the presence of fire. Most fire detection systems do not indicate the particular area of the cargo bay where the fire is located. Also, the crew is not given any forewarning that a particular area has a very high temperature (overheat condition). The awareness of an overheat condition is advantageous because it would provide time for the crew to evaluate the potential fire condition and decide the appropriate action to be taken. For example, an overheat condition may trigger the use of one of the various mechanisms aboard the aircraft to suppress the fire or overheat condition.

Thus, a need exists for an effective fire and overheat detection system for aircraft cargo bays that provides the pilot and crew with sufficient information and time to take the proper action.

SUMMARY OF THE INVENTION

The present invention is an infrared fire and overheat detection system for aircraft cargo bays. In the preferred embodiment, the present invention comprises two control units and up to sixteen thermal imaging modules. Each control unit is connected to up to eight thermal imaging modules and monitors the entire area cargo bay for an overheat condition. Thus, any particular area of the cargo bay is viewed by two thermal imaging modules to assure detection and avoid failure of the system.

The control units monitor the thermal imaging modules and assert an overheat signal if two adjacent thermal imaging modules detect an overheat condition for more than five seconds. If only one thermal imaging module detects the overheat condition, the control unit waits fifteen seconds before sending the overheat signal. The control units also execute routines to monitor and test their operational status and that of each thermal imaging module. The control units are also connected to the aircraft electronics to indicate the location of a detected overheat condition when detected or any malfunction in the control units and thermal imaging modules.

The thermal imaging modules of the present invention are infrared sensors located in the cargo bay to monitor the level of radiation. All the thermal imaging modules are preferably identical and comprise an infrared detector, a rotating optical assembly, threshold circuitry and a motor. The optical assembly is rotated by the motor to effectively provide the detector with a conical field of view. The optical assembly focuses the radiation in the cargo bay on the infrared detector. The infrared detector measures the radiation level and outputs a voltage corresponding to the level of the radiation detected to the threshold circuitry. If the radiation level indicates a temperature greater than a preset level, 200° C. for example, then the threshold circuitry asserts a overheat signal that is output to the control unit. The thermal imaging module also includes a thermal switch that will trigger an overheat signal if the temperature of the module itself is above 85° C. The present invention also reduces the weight of the system by using a daisy-chain connection between the control unit and the thermal imaging modules.

DESCRIPTION OF THE PREFERRED EMBODIMENT

Figure 6:
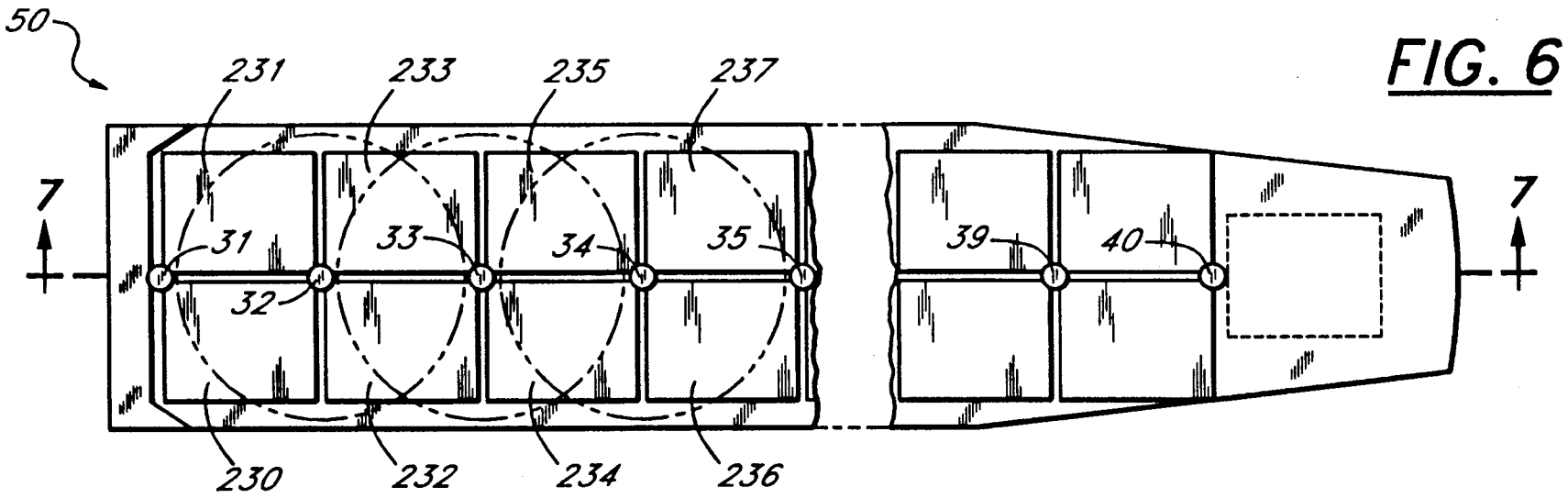
FIG. 6 is a top plan view of an aircraft cargo bay with the optical overheat and fire detection system of the present invention.
Figure 7:
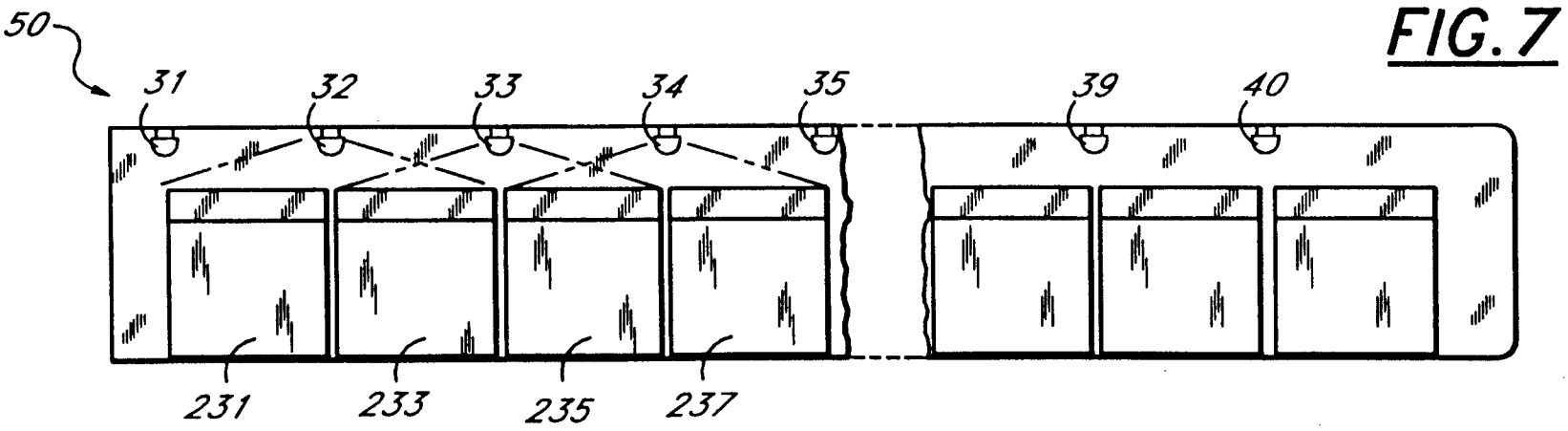
FIG. 7 is a side elevation view of an aircraft cargo bay of FIG. 6 taken on line 7—7.

The existence of fire can be detected in several different ways. The prior art has relied primarily on the presence of smoke to detect fire. However, fires also produce heat, infrared radiation, ultraviolet radiation and visible light. The present invention advantageously overcomes the problems in the prior by detecting fire by measuring the level of infrared radiation. The present invention is an infrared overheat and fire detection system 20 for an aircraft cargo bay 50 (FIGS. 6 and 7).

Figure 1:
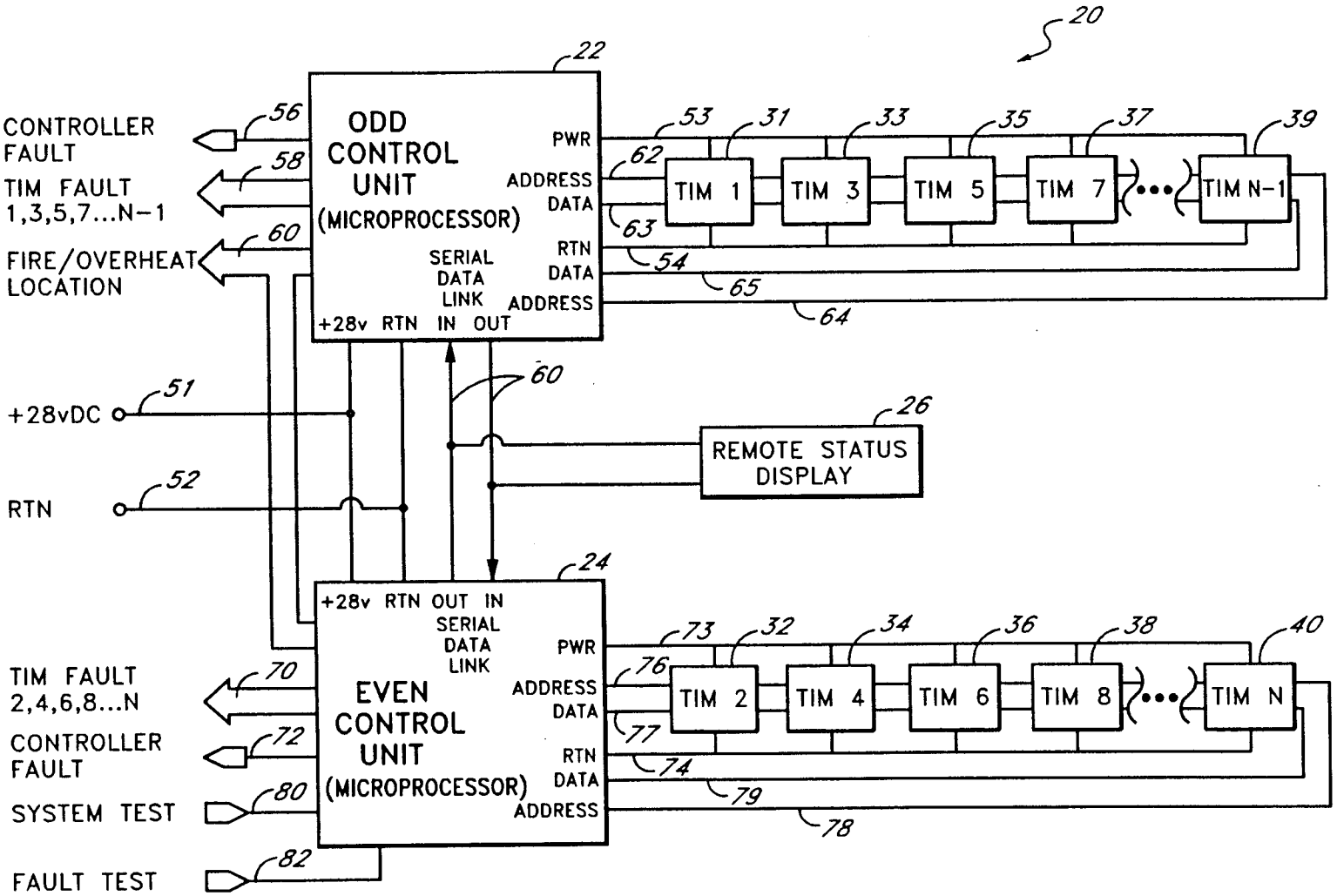
FIG. 1 is a block diagram of a preferred embodiment of the optical overheat and fire detection system of the present invention.

Referring now to the block diagram of FIG. 1, the preferred embodiment for the optical overheat and fire detection system 20 of the present invention is illustrated and comprises an odd control unit 22, an even control unit 24, a remote status display 26 and a plurality of thermal imaging modules (TIM) 31–40. Each thermal imaging module 31–40 is a senor that views an area of a cargo bay 50 and measures the level of infrared radiation present. The thermal imaging modules 31–40 are positioned throughout the cargo bay 50 and communicate with the control units 22, 24 which assert signals to indicate a fire or overheat condition if the infrared radiation reaches a specified level. While the preferred embodiment of the present invention illustrates only ten thermal imaging modules 31–40, it should be understood that the number of thermal imaging modules 31–40 may be reduced or increased as necessary to provide coverage for the area of the cargo bay 50. In an exemplary embodiment, the detection system has 16 thermal imaging modules with 8 being connected to each control unit 22, 24.

The preferred embodiment of the detection system 20 advantageously provides redundancy with two control units 22, 24 and twice as many thermal imaging modules as necessary to monitor the cargo bay 50. Each control unit 22, 24 and its associated thermal imaging modules 31–40 form a separate detection system. The control units 22, 24 preferably work together to indicate a fire or overheat condition. However, the detection system 20 allows either control unit 22, 24 to operate alone in the event of a failure of the other control unit 22, 24. Each control unit 22, 24 is coupled to a different group of thermal imaging modules 31–40 to independently monitor the cargo bay 50 and provide built-in redundancy. Every area in the entire cargo bay 50 is monitored by at least two thermal imaging modules 31–40. The odd numbered thermal imaging modules 31, 33, 35, 37, and 39 are sufficient to monitor the entire area of the cargo bay 50 and are coupled to the odd control unit 22. Similarly, the even numbered thermal imaging modules 32, 34, 36, 38, and 40 are coupled to the even control unit 24 and also monitor the entire area of the cargo bay 50 in the event that any of the odd thermal imaging modules 31, 33, 35, 37, and 39 becomes inoperable.

In the preferred embodiment, the control units 22, 24 are controller cards including memory and a microprocessor (not shown) to collect data from the thermal imaging modules 31–40 and signal the crew. The control units 22, 24 are preferably located in the avionics rack of the cockpit (not shown). The control units 22, 24 output signals to communicate with the aircraft's electronics (not shown) to assert fire warning signals and respond to self-test signals. The control units 22, 24 also include self-test electronics as easily understood by one skilled in the art.

As illustrated in FIG. 1, the odd control unit 22 sends and receives several signals to the aircraft electronics. The odd control unit 22 receives power from the aircraft's electronics on lines 51 and 52, and also provides power to the odd numbered thermal imaging modules 31, 33, 35, 37, and 39 on lines 53 and 54. A CONTROLLER FAULT signal is output to the aircraft electronics on line 56 and asserted to indicate a problem in the control unit 22. A TIM FAULT signal identifying any defective thermal imaging modules(s) 31, 33, 35, 37, and 39 is asserted on lines 58 if the control unit 22 determines that any thermal imaging module 31, 33, 35, 37, and 39 is inoperative. A FIRE/OVERHEAT LOCATION signal is output on lines 60. This signal tells the aircraft electronics the position in the cargo bay 50 where the thermal imaging module 31–40 was triggered.

The control unit 22 may also receive or send information to the other control unit 24 along a serial data link 60 (I/O port). The serial data link 60 is connected between the odd control unit 22 and the even control unit 24. The data link 60 is also connected to the remote status display 26. Thus, any alarm signal or the operational status of each thermal imaging module 31–40 is sent to the remote status display 26. In the preferred embodiment, the remote status display 26 comprises a plurality of lamp indicators to show the location of the detected overheat or fire condition in the cargo bay 50. The remote status display 26 may also include an audio alarm to attract the attention of the crew. The remote status display 26 is preferably located in or near the cargo bay 50 so that it may be used by personnel to determine where the fire is located and the proper action to be taken to eliminate the hazardous condition or verify its existence.

The odd control unit 22 has additional connections to two thermal imaging modules 31 and 39. An address line 62 and a data line 63 connects the odd control unit 22 to the first thermal imaging module(TIM1) 31. The address line 62 is used by the odd control unit 22 to prompt the TIM1 31 to respond with the status of the TIM1 31. The data lines 63 are used by the thermal imaging module 31 to communicate whether a fire or overheat condition has been detected. In the preferred embodiment, the thermal imaging module 31 provides a stepped voltage signal to indicate its status. Preferably, a voltage of 1.5 volts is output as a confirmation signal that the thermal imaging module 31 is working. A voltage of 4.0 volts is output as a fault signal to indicate failure of a thermal imaging module and a voltage output of 5.5 volts indicates a fire or overheat condition. Under certain circumstances it is possible to have both a fault condition and a overheat condition. A 7.5-volt step is provided to apprise the control unit 22 of such a situation.

As illustrated in FIG. 1, the thermal imaging modules 31, 33, 35, 37 and 39 are preferably wired in a daisy-chained connection. Thus, after a signal is placed on the address line 62 it propagates forward allowing interrogation of each thermal imaging modules 31, 33, 35, 37, and 39 in turn. The present invention advantageously also has another address line 64 and a data line 65 connected to the (N−1)th thermal imaging module (TIMN−1) 39. These address and data lines 64, 65 have the same function as the lines connected to the first thermal imaging module 31. However, the address and data lines 64, 65 connected to the (N−1)th thermal imaging module 39 allow the thermal imaging modules 31, 33, 35, 37 and 39 to be interrogated in a reverse order beginning with the (N−1)th thermal imaging module 39 and ending with the first thermal imaging module 31.

The even control unit 24 is very similar to the odd control unit 22. It receives power from the aircraft electronics on lines 51 and 52, uses it internally and also provides power to the thermal imaging modules 32, 34, 36, 38, and 40 along lines 73, 74. The even control unit 24 asserts a FIRE/OVERHEAT LOCATION signal to indicate a fire or overheat condition and the location of the condition on line 60. The even control unit 24 sends a CONTROLLER FAULT signal on line 72 or a TIM FAULT signal on line 70 to the aircraft electronics to indicate the even control unit 24 or the thermal imaging module(s) 32, 34, 36, 38 and 40, respectively are inoperative. The even control unit 24 is also connected by an address line 76 and a data line 77 to the second thermal imaging module (TIM2) 32. This allows the even control unit 24 to interrogate the thermal imaging modules 32, 34, 36, 38 and 40 in a forward direction. An address 78 and data 79 line also connect the even control unit 24 to the Nth thermal imaging module (TIMN) 40 for interrogation of the even numbered modules 32, 34, 36, 38 and 40 in the reverse direction.

The even control unit 24 additionally receives manual signals from the aircraft electronics. On a line 80, the even control unit 24 receives a SYSTEM TEST signal, and on a line 82, a FAULT TEST signal is received. These are manually asserted by the pilot or crew to initiate tests of the system and its components. The assertion of the fault signal will provide a test to determine which, if any, of the thermal imaging modules 31–40 or control units 22, 24 are not operational. The assertion of the SYSTEM TEST will initiate an internal optical emitter that should trigger an alarm and thereby test the integrity of the entire system.

Referring now to FIGS. 2–5, the thermal imaging module 31 will be described with particularity. In the preferred embodiment, the thermal imaging modules 31–40 are all identical and interchangeable. Thus, for ease of understanding only the first thermal imaging module 31 will be described. The thermal imaging module 31 is basically an infrared sensor located in the cargo bay 50 to detect fire. The present invention advantageously detects fire by measuring the level of infrared radiation. In a preferred embodiment, the thermal imaging module . 31 comprises a housing 90, a cover 92, a lens 94, a motor 96, a connector 98, an infrared detector 100 and other circuitry.

Figure 2:
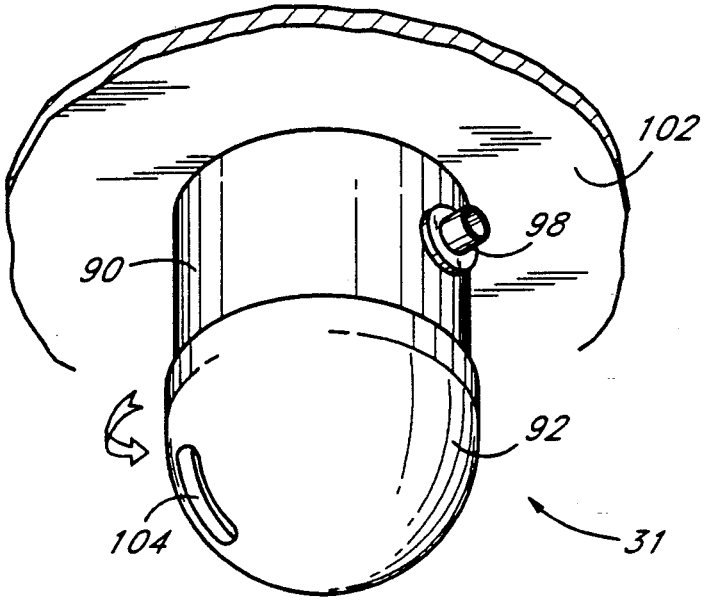
FIG. 2 is a perspective view of a preferred embodiment of the thermal imaging module of the present invention.

Referring to FIG. 2, the thermal imaging module 31 is illustrated mounted to the ceiling of the aircraft body 102. Such mounting provides the lens 94 with a view of the area below the thermal imaging module 31. The exterior of the thermal imaging module 31 is formed by the housing 90 and cover 92. The housing 90 is preferably a generally cylindrical shape to hold the motor 96, infrared detector 100 and other circuitry. The connector 98 is positioned along the exterior wall of the housing 90 to receive cables attached to the other thermal imaging modules 32–40 and to the control units 22, 24. In an exemplary embodiment the housing 90 has a diameter of about 4.0" and a height of about 4.0".

The cover 92 has a semi-spherical shape and forms a dome for the housing 90. The cover 92 is sized to fit closely over and enclose the housing 90. Along the exterior of the cover 92 there is an opening 104 at a position intermediate the top and the bottom of the dome formed by the cover 92. The opening 104 holds the lens 94 in place and permits infrared radiation to enter the housing 90. While the housing 90 has a stationary position, the cover 92 advantageously rotates about the longitudinal axis of the housing 90 to give the lens 94 a wider ring-shaped conical field of view. The lens 94 and cover 92 advantageously form part of an optical assembly used to direct infrared radiation toward the infrared detector 100.

Figure 3:
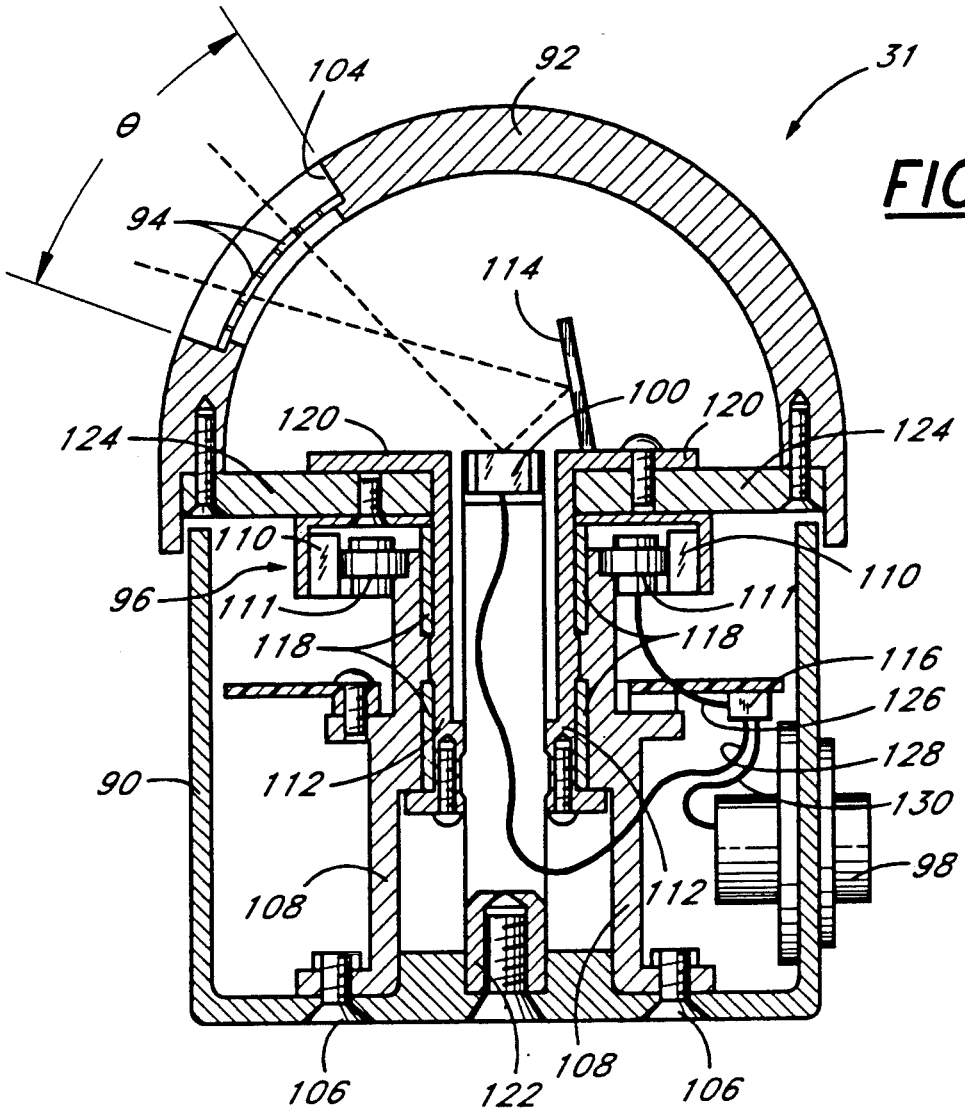
FIG. 3 is a cross-sectional view of the thermal imaging module of FIG. 2.

As best seen in FIG. 3, a preferred embodiment of the present invention has a stepped base 108 mounted on the interior of the housing 90 with a pair of fasteners 106. The stepped base 108 has a generally cylindrical shape and parallels the walls of the housing 90. At an intermediate position along the length of the stepped base 108, an first step provides an area for mounting a circuit board 116. The circuit board 116 is connected to the motor 96, the infrared detector 100 and the connector 98 by the leads 126, 128 and 130 respectively. At end of the stepped base 108, distal the housing 90, coils 111 of the motor 96 are mounted on a second step. The coils 111 interact with the motor magnets 110 attached to a flat side 124 of the cover 92 to provide the driving torque that causes the cover 92 to rotate. In the preferred embodiment, the motor 96 is a brushless D.C. motor. The stepped base 108 also engages a tubular member 112 attached to the cover 92. The tubular member 112 has a flange 120 on the end proximate the cover 92 that allows attachment of the tubular member 112 with the flange 120 inside the cover 92. The tubular member 112 fits closely within the stepped base 108 and bearings 118 are provided to reduce the friction and resistance to rotation.

The housing 90 also includes a pole 122 centered along the longitudinal axis. The pole 122 extends away from the housing 90 toward the cover 92. The pole 122 is advantageously sized to fit within the tubular member 112 attached to the cover 92. The infrared detector 100 is mounted on the end of the pole 122 distal the housing 90. The pole 122 positions the infrared detector 100 level with the flange 120 of the tubular member 112.

The thermal imaging module 31 preferably includes an infrared optical assembly for measuring the level of infrared radiation in the cargo bay 50. The infrared optical assembly includes the lens 94, the cover 92, the infrared detector 100 and a reflector 114. The cover 92 preferably encloses the infrared detector 100 and limits the field of view for the infrared detector 100. The cover 92 provides an opening 104 as described above that allows radiation to enter the cover 92. The opening 104 preferably has a substantially rectangular shape with the lens 94 positioned inside the opening 104. The lens 94 is used with the reflector 114 to provide a field of view defined by the angle $\theta$. The angle $\theta$ can range from 0° to 90°. The reflector 114 helps focus the lens 94 on the infrared detector 100. In the preferred embodiment, a field of view of about 70° is provided. For example, the lens 94 may be constructed of seven fresnel lenses which are focused on the infrared detector 100. The beam centers for the seven lenses are spaced radially every 10° and each lens has a 10° conical field of view. Thus, the effective field of view is about 70° by 10°. As the infrared optical assembly is rotated each of the lenses scribe concentric rings to view a substantially conical area from the ceiling toward the base of the cargo bay 50.

Figure 4:
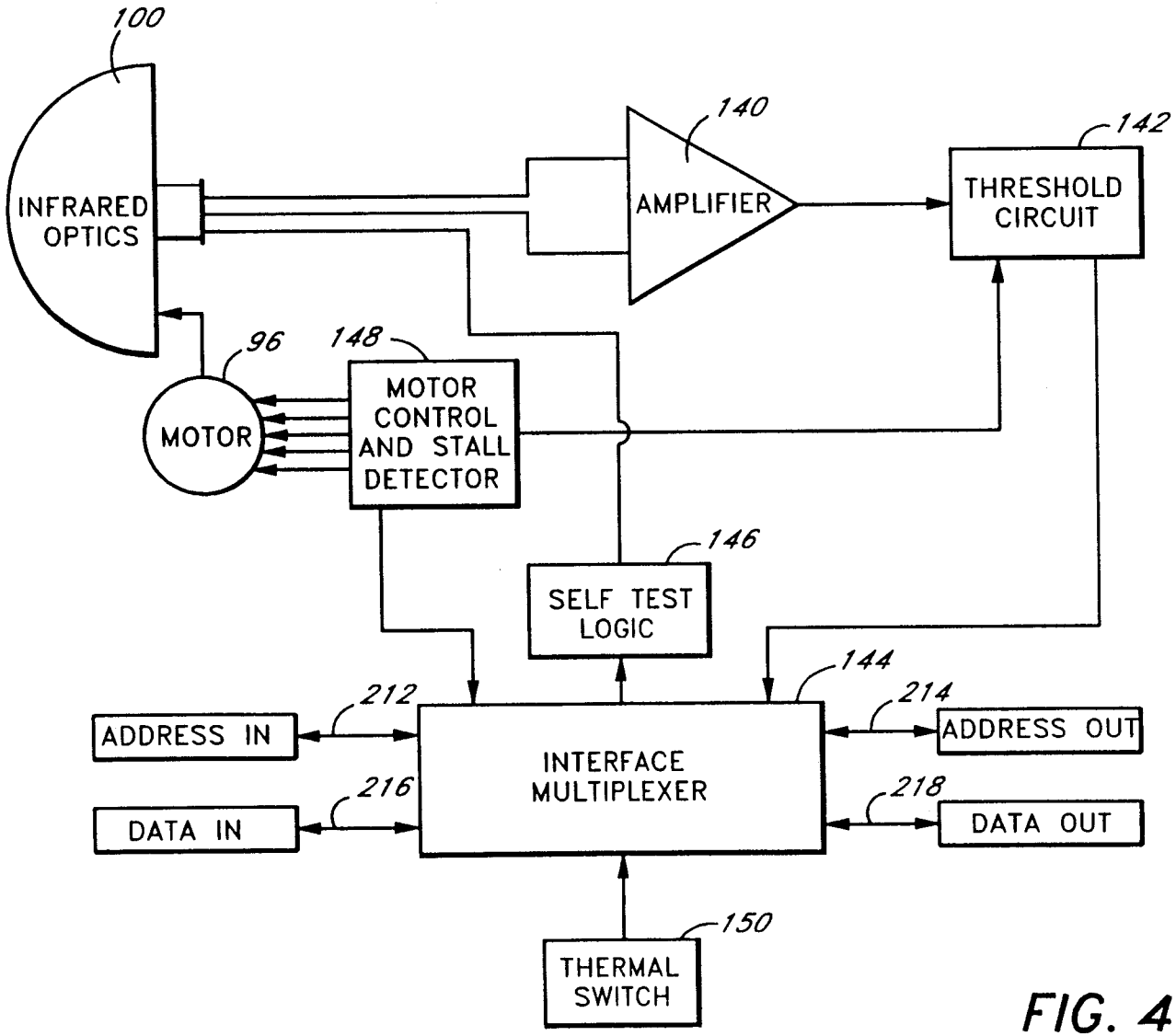
FIG. 4 is a block diagram of a preferred embodiment for the circuitry of the thermal imaging module.

Referring now to FIG. 4, a block diagram of the circuitry for the thermal imaging module 31 is shown. In the preferred embodiment, the thermal imaging module 31 further comprises an amplifier 140, a threshold circuit 142, an interface multiplexer 144, self test logic 146, a motor control and stall detector 148, and a thermal switch 150. As illustrated in FIG. 4, the output of the infrared detector 100 is connected to the amplifier 140. The amplifier 140 increases the magnitude of the signal produced by the infrared detector 100, filters out noise, and outputs the signal to the threshold circuit 142. The threshold circuit 142 measures the signal from the amplifier 140 and outputs an overheat signal if the measured signal indicates radiation above the level or an overheat or fire condition. The threshold circuit 142 is connected to the interface multiplexer 144 which receives the overheat signal and forwards the signal to the control unit 22. The interface multiplexer 144 receives and sends information on the data and address lines 212, 214, 216 and 218 at the appropriate times and in the appropriate format.

Figure 5:
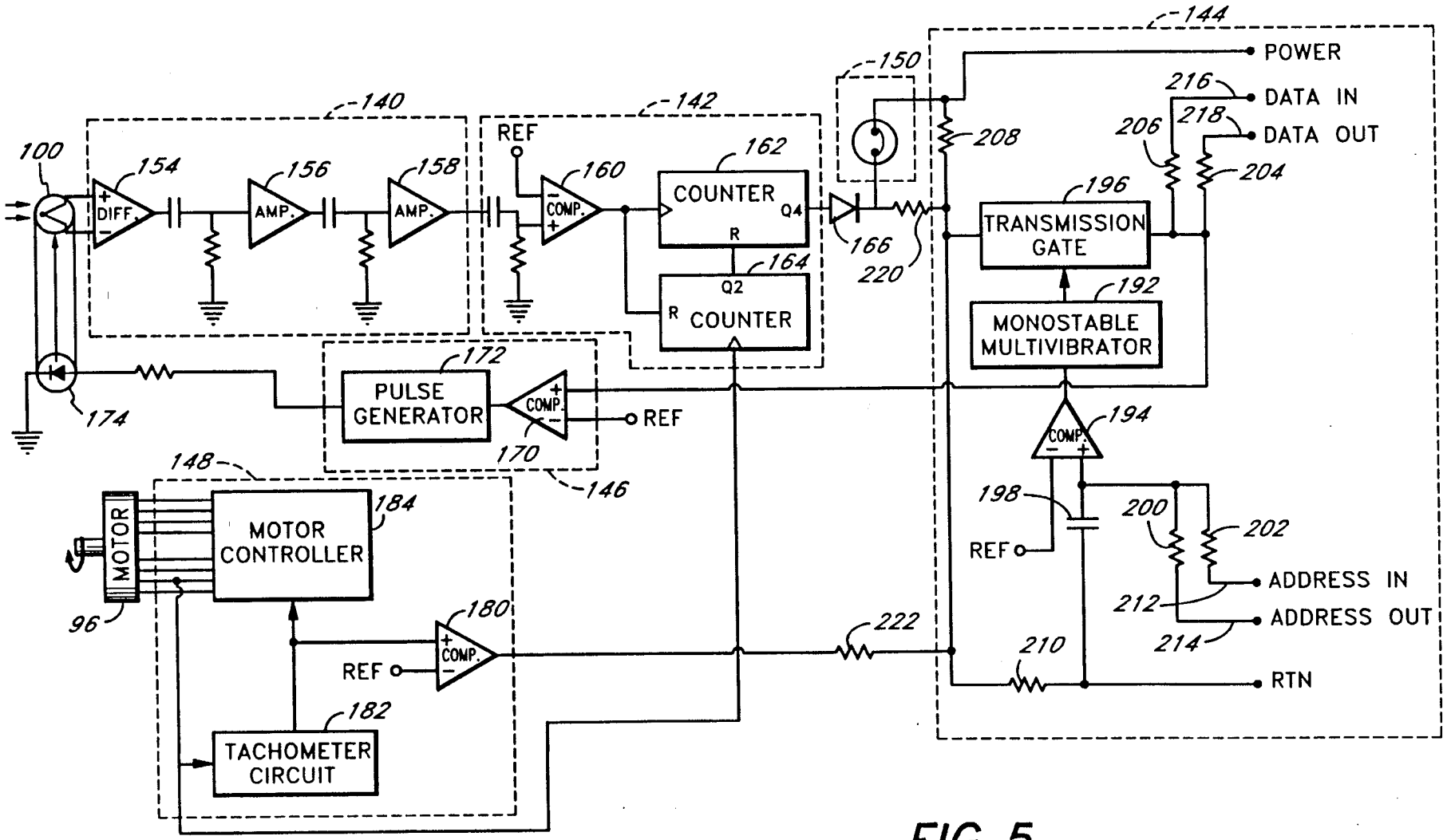
FIG. 5 is a schematic diagram for the circuitry of the thermal imaging module.

Referring to the schematic of FIG. 5, the circuitry of the thermal imaging module 31 is shown in more detail. The thermal imaging module 31 advantageously has two sensors to detect the presence of a fire. One sensor is the thermal switch 150. The thermal switch 150 is preferably a switch that closes if the temperature of the switch 150 itself exceeds about 85° C. Once the switch 150 closes an overheat signal is sent to the interface multiplexer 144. The thermal switch 150 advantageously avoids failure of the detection system 20 in the event the fire produces very dense smoke which may decrease or eliminate the ability of the systems optics to detect the presence of fire or an overheat condition.

The main sensor is the infrared detector 100 that measures the amount of infrared radiation present in the area scanned. In an exemplary embodiment, the infrared detector 100 is a 4.35 micron filtered, uncooled thermopile. The infrared energy collected by the infrared detector 100 is converted into a small voltage. Thus, the voltage produced by the infrared detector 100 translates into the amount of infrared radiation present. Since an overheat condition or a fire produces a significant amount of infrared radiation, the presence of a fire can be established if the amount of infrared radiation reaches a specified level. Since the infrared detector 100 is rotated by the motor 96, any hot spot or area of high radiation will produce a pulse since the amount of radiation sensed by the detector will increase drastically as the lens 94 sweeps over the hot spot.

The voltage pulses produced by the infrared detector 100 and the rotation of the optical assembly are then output to the amplifier 140. The amplifier 140 comprises a differential amplifier 154, two high gain amplifiers 156, 158 and other passive components. The differential amplifier 154 receives the voltage from the infrared detector 100 and outputs an amplified signal to the high gain amplifiers 156, 158 which in turn further amplify the signal and output it to the threshold circuit 142. In the preferred embodiment, the differential amplifier 154 is a low noise, high gain A.C. amplifier.

The output of the amplifier 140 is provided as input to the threshold circuit 142 which comprises a comparator 160, and two counters 162, 164. The threshold circuit 142 receives the signal from the amplifier 140 and inputs the signal to the comparator 160. The comparator 160 compares the signal input to a reference voltage(REF). The output of the comparator 160 is provided to the clock of the first counter 162 and the reset of the second counter 164. The second counter 164 is clocked by a signal from the motor control and stall detector 148. The reset of the first counter 162 is connected to the $Q_2$ output of the second counter 164. The $Q_4$ output of the counter 162 is bufferred by a diode 166 to provide the overheat signal.

The pulses from the amplifier 140 are compared by the comparator 160 to determine whether they are greater than the predetermined threshold. The threshold is preferably set so that an overheat condition where the temperature is greater than 200° C. or a fire will produce a pulse on the output of the comparator 160 to clock the counter 162. The overheat signal will only be triggered after five pulses in five consecutive rotations of the infrared detector 100 are recorded. The pulses are provided as the clock to the counter 162 and once five pulses have been received the $Q_4$ output of the counter 162 will be asserted. To assure that the pulses occur in consecutive rotations of the optica assembly, the $Q_2$ output of the second counter 164 is used to reset the first counter 162. The second counter 164 is reset by the pulses from the comparator 160, and clocked by the motor control and stall detector 148 which provides one pulse per revolution of the infrared detector 100. Thus, if the second counter 164 is clocked twice without being reset, indicating at least one revolution without a pulse from the infrared detector 100, the first counter 162 will be reset to avoid triggering a false overheat signal.

The thermal imaging module 31 also has self-test logic 146. As shown in FIG. 5, the self-test logic 146 preferably includes a comparator 170, a pulse generator 172 and an infrared emitter 174. The positive input of the comparator 170 is connected through the interface multiplexer 144 to the data line 216, 218, and the negative input is connected to the reference voltage. The output of the comparator 170 is connected to the pulse generator 172, which in the preferred embodiment oscillates at 10 Hz. The output of the pulse generator 172 is connected to drive the infrared emitter 174 that is positioned near the infrared detector 100. In the preferred embodiment, the control unit 22 may initiate a self test by placing the appropriate voltage on the data line 216, 218. The appropriate voltage will be receive by the comparator 170 which will activate the pulse generator 172. The pulse generator 172 produces pulses at 10 Hz to drive the infrared emitter 174. The pulses are converted by the infrared emitter 174 into infrared radiation. The amount of radiation produced by the infrared emitter 174 is advantageously designed to simulate the radiation that would be present with a fire. Once the infrared emitter 174 is activated, the detector system 20 should trigger an alarm. Thus, the self-test logic 146 allows the integrity of the entire system to be tested.

The motor control and stall detector 148 comprises a comparator 180, a tachometer circuit 182 and a motor controller 184. The motor 96 rotates the optical assembly for the infrared detector 100 and is preferably a brushless D.C. motor. The motor 96 is connected to and driven by the motor controller 184. In the preferred embodiment, the motor controller 184 is a speed regulated, pulse width modulated current controller chip that operates in a conventional manner to drive the motor 96 at an angular velocity of about 60 RPM. The tachometer circuit 182 is connected to motor 96 and the motor controller 184 to receive a signal that provides one pulse per rotation of the motor 96. This is the same signal is sent to the threshold circuit 142. The tachometer circuit 182 measures the rate of rotation and outputs a motor speed signal indicating the speed of rotation. The motor speed signal is used by the motor controller 184 to maintain the rotation rate at about 60 RPM. The tachometer circuit 182 is also connected to the negative input of the comparator 180. The positive input of the comparator 180 is connected to the reference voltage. If the motor speed signal is below a predetermined rate, the comparator 180 will output a signal of about 5.5 volts to indicate that the motor 96 is rotating at an unacceptably slow rate, if at all. The output of the comparator 180 is coupled to the interface multiplexer 144 to alert the control unit 22 of a fault condition in the thermal imaging module 31.

The final component of the thermal imaging module 31 is the interface multiplexer 144 which communicates with the control unit 22. In response to an inquisition signal from the control unit 22 on the address lines 212, 214, the interface multiplexer 144 outputs signals from other components of the thermal imaging module 31 on the data lines 216, 218. The interface multiplexer 144 reduces the weight of the system by using a two line serial interface for communication between the thermal imaging module 31 and the control unit 22 or other thermal imaging modules 32–40. The interface multiplexer 144 advantageously uses a serial pulse delay scheme in which the control unit 22 provides a pulse on the address line 62, 64 and in response the interface multiplexer 144 outputs signals onto the data line 63. The pulse provided to the thermal imaging module 31 is output on the ADDRESS OUT line 214 to the next thermal imaging module 33 in the chain. In the preferred embodiment, the address line 62 and data line 63 of the control unit 22 are connected to the ADDRESS IN line 212 and the DATA IN line 216 of the interface multiplexer 144, respectively. The ADDRESS OUT line 214 and the DATA OUT line 218 are connected to the ADDRESS IN and DATA IN lines of the third thermal imaging module (TIM3) 33, respectively, to chain TIM1 31 to TIM3 33. This allows the address and data information to be propagated to the next thermal imaging module 33 in the chain. It should be understood that the input and outputs of the remaining thermal imaging modules 32–40 are similarly connected together in two daisy chain combinations as illustrated in FIG. 1.

As shown in FIG. 5, a delay circuit or RC timer of the interface multiplexer 144 preferably comprises a pair of resistors 200, 202, a capacitor 198 and a comparator 194. One end of each resistor 200, 202 and the capacitor 198 are connected to the non-inverting input (+) of the comparator 194. The other end of the resistors 200, 202 and the capacitor 198 are respectively attached to the ADDRESS IN line 212, the ADDRESS OUT line 212 and the negative return (RTN). The inverting input (−) of the comparator 194 is connected to the reference voltage. The resistors 200, 202 and the capacitor 198 form a RC timer to delay the inquisition signal since time is required to charge the capacitor 198 and apply the signal to the noninverting input of the comparator 194. After the capacitor 198 is charged then the comparator 194 will provide a signal that permits the interface multiplexer 144 to output data on the data lines 216, 218.

The interface multiplexer 144 also comprises a monostable multivibrator 192 and a transmission gate 196 for sending signals on the data lines 216, 218. The monostable multivibrator 192 preferably has an active duration of 100μs. The monostable multivibrator 192 is triggered by the output of the comparator 194. The output of the monostable multivibrator 192 is connected to the transmission gate 196 and controls whether the transmission gate is open or closed. The transmission gate 196 is normally closed and does not permit the signals on the input of the transmission gate 196 to propagate to its output. However, the assertion of the output of the monostable multivibrator 192 causes the transmission gate 196 to close and output the data on its input.

The input of the transmission gate 196 is coupled to the output of the threshold circuit 142, the motor control and stall detector 148 and the thermal switch 150. The input of the transmission gate 196 is connected through a resistor 220 to the thermal switch 150 and the cathode of a diode 166. If either the thermal switch 150 or the counter 162 asserts the overheat signal, a 4.0-volt voltage level is received on the input of the transmission gate 196. Similarly, the input of the transmission gate 196 is connected by a resistor 222 to the comparator 180 of the motor control and stall detector 148. If a fault signal is asserted by the comparator 180 then a voltage of 5.5 volts is received on the input of the transmission gate 196. The input of the transmission gate 196 is also connected to a 12-volt reference (POWER) by a resistor 208 and to the negative return by a resistor 210. The resistors 208 and 210 are a voltage divider to maintain the confirmation signal of 1.5 volts on the input of the transmission gate 196. The confirmation signal tells the control unit 22 that the thermal imaging module 31 is operational.

The output of the transmission gate 196 is connected by a resistor 204 to the DATA IN line 216 and by a resistor 206 to the DATA OUT line 218. The output of the transmission gate 196 is also connected to the self-test logic 146. This provides a path for the control unit 22 to send a signal to the self-test logic 146 to initiate a full test of the system.

As discussed above with reference to FIG. 1, the detection system 20 preferably uses a plurality of thermal imaging modules 31–40. The modules 31–40 are used to measure infrared radiation in the cargo bay 50. As illustrated in the top view of FIG. 6 and the side view of FIG. 7, the cargo bay 50 holds several containers or pallets 231–237. For example, the containers 231–237 are positioned in two extending from the forward end to the aft end of the cargo bay 50. The present invention advantageously attaches the thermal imaging modules 31–40 to the ceiling along the longitudinal axis of the cargo bay 50. Each thermal imaging module 31–40 is placed above a four corner juncture of containers 231–237. For example, TIM2 32 is located above the juncture between containers 230–233, TIM3 33 is above the juncture between the containers 232–235, and the TIM4 34 is above the juncture between containers 234–237. Each thermal imaging module 32–34 preferably scans the four containers 230–237 above which it is positioned. Placement of the thermal imaging modules 31–40 over adjacent junctures advantageously provides an overlap in the area viewed by each thermal imaging module 31–40. For example, TIM3 33 views two containers 232, 233 also viewed by TIM2 32, and two containers 234, 235 also viewed by TIM4 34, as shown by the phantom lines in FIGS. 6 and 7. Therefore, the entire area of the cargo bay 50 may be scanned either by the odd numbered thermal imaging modules 31, 33, 35, 37 and 39 or by the even numbered thermal imaging modules 32, 34, 36, 38 and 40. The double coverage provided by positioning thermal imaging modules 31–40 over every juncture of containers 231–237 is advantageous because it allows the particular row in which a fire or overheat condition is detected to be isolated. Since there is a thermal imaging module 31–40 at every juncture, an overheat condition in any container 231-237 will trigger two thermal imaging modules. For example, if there is a fire in the container 234 both TIM3 33 and TIM4 34 will be triggered. Thus, the present system allows the location of the fire or overheat condition to be determined with better accuracy. The double coverage is also advantageous in the event a control unit 22, 24 or a thermal imaging module 31-40 fails. As mentioned above, the odd number thermal imaging modules 31, 33, 35, 37 and 39 are coupled to a different control unit 22 than the even numbered thermal imaging modules 32, 34, 36, 38 and 40. Thus, if one control unit 22, 24 becomes disabled then the cargo bay 50 may still be monitored with the other control unit 22, 24 and its associated thermal imaging modules 31-40. Similarly, the redundancy also reduces the chances that the detection system 20 will be affected by the failure of any thermal imaging module 31-40.

The operation of the fire detection system 20 is controlled by the control units 22, 24 which interrogate the thermal imaging modules 21-40 to determine if a fire is present. The thermal imaging modules 31-40 respond by placing a status signal on the data line 63. In the preferred embodiment, the status signal may be either a confidence signal (1.5-volt step), a fault signal (4.0-volt step), or an overheat signal (5.5-volt step). If both a fault and overheat signal are present, then the status signal is a 7.5-volt step. If no status signal is placed on the data line for the time frame assigned, then the control unit 22 is alerted to a potential failure of the thermal imaging module. It should be understood that the voltage levels given above for the status signal may take any other values desired by varying the value of the resistors 208, 210, 220 and 222 that connect the threshold circuit 142 and the motor control and stall detector 148 to the input of the transmission gate 196.

A time multiplexing connection is used for communication between the control units 22, 24 and the thermal imaging modules 31-40. In the time multiplexing connection, the control units 22, 24 assign each thermal imaging module a time slot in the communication cycle to interface with its control unit 22, 24. Thus, if a thermal imaging module 31-40 does not respond within its assigned time slot the control unit 22, 24 recognizes that particular thermal imaging module is malfunctioning. The communication cycle between the control units 22, 24 and its associated thermal imaging modules 31-40 begins by interrogating the first thermal imaging module 31 and continuing down the chain through each thermal imaging module 33, 35, 37 and 39.

The control unit 22 will begin a communication cycle by placing an inquisition signal on the address line 62. The inquisition signal is received by TIM1 31 which responds after a preset delay by placing its status signal on the DATA IN line 63, 216 for 100μs. After the preset delay, the TIM1 31 also outputs a new inquisition signal to TIM3 33 on the ADDRESS OUT line 214 of TIM1 31 connected to the ADDRESS IN line of TIM3 33. TIM3 33 responds by placing its status signal on the DATA IN line after a preset delay which is connected to the DATA OUT line of 218 of TIM1. The status signal proceeds through the interface multiplexer 144 of TIM1 and is input to the control unit 22 on line 63. The interrogation of each thermal imaging module in the daisy chain connection occurs in a similar fashion until all the thermal imaging modules have been polled. Thus, the N−1 TIM 39 does not receive the inquisition signal until it has been delayed by all the thermal imaging modules 31, 33, 35 and 37 in the chain. In a preferred embodiment, the preset delay is achieved with an RC timer in each thermal imaging module as described above with reference to FIG. 5. The communications cycles are being executed during about 1/20 of time and inactive during the remaining time to allow the capacitors 198 in each thermal imaging module to discharge.

Figure 8:
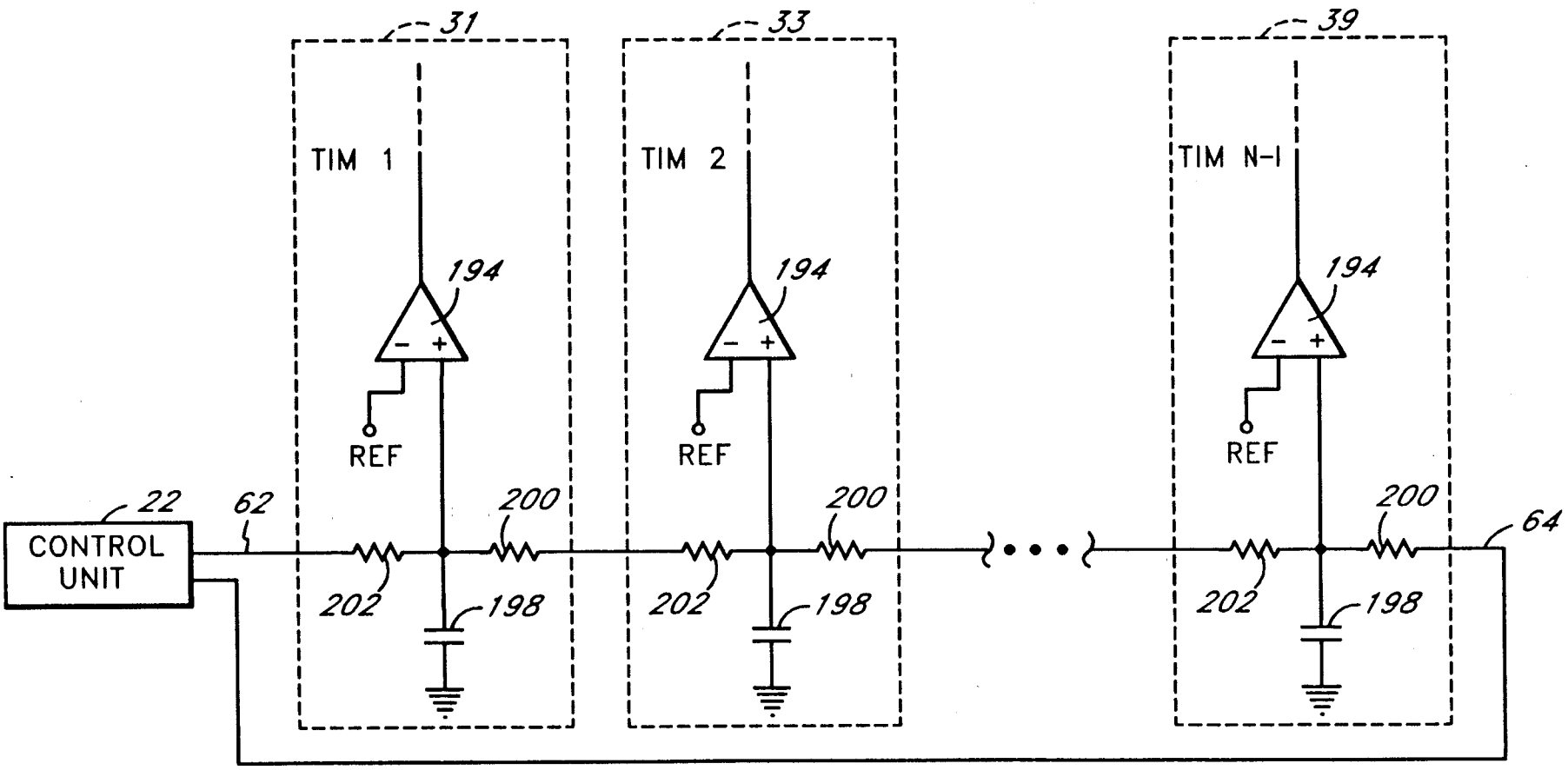
FIG. 8 is a schematic diagram of the preferred interconnection for the thermal imaging modules.

The propagation delay for the inquisition signal can best be understood with reference to FIG. 8. FIG. 8 is a partial schematic diagram showing the daisy chain connection of the odd numbered thermal imaging modules 31, 33 39. The inquisition signal is output by the control unit 22 on the line 62. The signal will first charge the capacitor 198 of TIM1 31. Once the capacitor 198 of TIM1 31 is charged to the threshold voltage of the comparator 194, the comparator 194 outputs an activation signal to the monostable multivibrator 192. The inquisition signal operates in a similar manner for the successive odd thermal imaging modules from TIM3 33 to TIMN-1 39; however, each successive thermal imaging module has additional resistors 200, 202 interposed between its capacitor 198 and the control unit 22. Thus, the voltage across each capacitor 198 in each TIM 33 . . . 39 will reach the threshold voltage of its respective comparator 194 to assert a signal at a progressively later time for each thermal imaging module in the chain. This has the effect of causing the inquisition signal to propagate between the thermal imaging modules.

The present invention adds to the reliability of the detector system 20 by making the address and data lines 212, 214, 216 and 218 bi-directional and connecting the odd control unit 22 directly to the N−1 thermal imaging module 39. The data and address lines are bi-directional in that either of the address lines 212, 214 may be used to input or output the inquisition signal to the thermal imaging module 31-40. Similarly, either data lines 216, 218 may be used to receive or send signals to the adjacent thermal imaging module or control unit 22, 24. The two additional lines 64, 65 provide a second path to interrogate the chain of thermal imaging modules 31, 33, 35, 37 and 39. This advantageously eliminates the possibility that the loss of a single thermal imaging module 31-40 will compromise the system 20. The additional address and data lines 64, 65 function in an manner identical to the address and data lines 62, 63 and provide access to the thermal imaging modules 31, 33, 35, 37 and 39 in reverse direction. For example, the same communication cycle as described above is used to poll each of the thermal imaging modules 31, 33, 35, 37 and 39 with the only difference being that the N−1 thermal imaging module 39 is the first to be interrogated and TIM1 31 is the last to be interrogated. Thus, if TIM5 becomes disabled all of the remaining modules 31, 333, 37 and 39 can be interrogated because TIM1 31 and TIM3 33 can be accessed using the lines 62, 63, and TIM7 37 and TIMN-1 39 can be accessed using the lines 64, 65.

In addition to executing the communication cycle to monitor the status of the thermal imaging modules 31-40, the control units 22, 24 generate fault and fire signals that are sent to the aircraft electronics. The control units 22, 24 are microprocessors, and therefore, can be easily programed by one skilled in the art to perform the routines to increase the accuracy of the detection system 20. For example, the control unit 22 monitors the status of the odd numbered thermal imaging modules 31, 33, 35, 37 and 39 and outputs a TIMS FAULT signal on lines 58 if any of the thermal imaging modules 31, 33, 35, 37 and 39 fail to respond after being interrogated from both the forward and reverse directions. The control unit 22 preferably interrogates each thermal imaging modules 31, 33, 35, 37 and 39 in the chain beginning with TIM1 31 and ending with TIMN-1 39 using the lines 62, 63. If any of the thermal imaging modules 31, 33, 35, 37 and 39 in the chain fails to respond with at least the confidence signal, then the control unit 22 attempts to obtain a response by interrogating the thermal imaging modules 31, 33, 35, 37 and 39 in the reverse direction beginning with TIMN-1 39 and using lines 64 and 65. For each thermal imaging module 31, 33, 35, 37 and 39 that failed to respond with at least the confidence signal in both the forward and reverse cycle direction, the control unit 22 then asserts the TIM FAULT signal to indicate the particular thermal imaging module 31, 33, 35, 37 and 39 that is defective. The even control unit 24 includes an identical routine to test the chain of even thermal imaging modules 32, 34, 36, 38 and 40 and determine which if any of the modules 32, 34, 36, 38 and 40 are defective.

The control units 22, 24 also include a routine for indicating an overheat or fire condition to the aircraft electronics. As mentioned above, all areas of the cargo bay 50 are viewed by at least two thermal imaging modules 31–40. Thus, any overheat or fire condition should be detected by two thermal imaging modules 31–40. In the preferred embodiment, the control units 22, 24 continually loop through the communication cycle to check the status of the thermal imaging modules 31–40 for any assertion of the overheat signal. If any thermal imaging module 31–40 outputs an overheat signal, the control unit 22, 24 will begin a low confidence routine and set a 15-second timer. During the 15-second low confidence routine, the control units 22, 24 continuously interrogate the thermal imaging modules 31–40. The control unit 22, 24 will output FIRE/OVERHEAT LOCATION signal if the thermal imaging module 31–40 continues to assert the overheat signal until 15 seconds has elapsed. If the thermal imaging module which started the low confidence routine does not assert the overheat signal in any communication cycle before 15 seconds elapses then the timer is reset, no alarm signal is sent to the aircraft electronics and the low confidence routine is ended. On the other hand, if another thermal imaging module 31–40, adjacent to the thermal imaging module which triggered the low confidence routine, asserts the overheat signal then a high confidence routine begins and a 5-second timer is set. If the overheat signal is continuously asserted for the 5 seconds then the FIRE/OVERHEAT LOCATION signal will be asserted by the appropriate control unit 22, 24. Each control unit 22, 24 is able to determine whether the adjacent thermal imaging modules 31–40 are asserting an overheat signal because the serial data link 60 allows for communication between the control units 22, 24 and adjacent thermal imaging modules 31–40 are connected to different control units 22, 24 as shown from FIGS. 1 and 6. The use of a 5-second- or 15-second delay before asserting a fire alarm is particularly advantageous because it keeps the confidence as high as possible to avoid false alarms with very little sacrifice in response time. It should be noted that either the low confidence routine or the high confidence routine may signal an FIRE/OVERHEAT condition. However, the low confidence routine can only identify the overheat condition as being in one of four containers since only one thermal imaging module 31–40 is triggered. The high confidence signal is able to limit the fire location to two containers since two thermal imaging modules 31–40 will have been triggered.

Finally, the control units 22, 24 also have the capability to perform self tests. The control units 22, 24 also control the assertion of fault diagnosis information at either the control units 22, 24 or the thermal imaging modules 31–40 in response to the FAULT TEST signal on line 82. In response to a FAULT TEST signal, the control units 22, 24 will identify any motor stalls in any of the thermal imaging modules 31–40 or control unit faults. Each control unit 22, 24 preferably includes a power on self-test to assure that both the control units 22, 24 are working. If either control unit 22, 24 is inoperative, then the self-test will result in a controller fault signal on lines 56, 72. The control units 22, 24 also perform a system test in response to assertion of the SYSTEM TEST signal on line 80. The system test preferably begins with the control units 22, 24 placing a signal (a high voltage) on the data lines 63, 77. The signal activates the self-test logic 146 and the infrared emitter 174 in each thermal imaging module 3140 which should trigger an alarm at all thermal imaging module 31–40 locations during the following communication cycle. This advantageously tests the all elements of the system 20 and their interconnection.

Having described the invention in connection with certain preferred embodiments thereof, it will be understood that many modifications and variations thereto are possible, all of which fall within the true spirit and scope of this invention.

What is claimed is:

1. A system for detecting fire comprising:

an aircraft having a cargo bay capable of holding cargo in cargo containers;

a plurality of cargo containers in said bay;

a control unit attached to said aircraft; and a plurality of thermal imaging modules coupled to said control unit and positioned in direct view of said cargo containers, said thermal imaging modules having an infrared detector for sensing an overheat condition on the outside of said cargo bay containers indicating a fire within said containers and outputting a signal to said control unit, said thermal imaging modules also sized and positioned in said cargo bay to not interfere with the loading and unloading of said cargo bay.

2. The system of claim 1, wherein said thermal imaging modules include an optical assembly that rotates to increase the field of view of said infrared detector and thereby increase the sensitivity of said infrared detector.

3. The system of claim 1, wherein each of said thermal imaging modules views a portion of the cargo bay, and wherein said thermal imaging modules are mounted in the cargo bay with most areas of the cargo bay viewed by two of said thermal imaging modules.

4. The system of claim 1, wherein a first and a last thermal imaging module are connected to said control unit with the remaining thermal imaging modules connected between said first and said last thermal imaging modules, and wherein each said thermal imaging module comprises an interface multiplexer thereby allowing bi-directional communication between each of said thermal imaging modules and said control unit.

5. A system for detecting fire in an aircraft having an electronic system, comprising:

a control unit;

at least one thermal imaging module connected to said control unit, said module comprising:

an infrared detector that outputs a signal corresponding to the level of infrared radiation; a stationary housing mounted to the aircraft, said stationary housing protecting said infrared detector positioned therein;

a rotating optical assembly attached to said housing for directing infrared radiation toward said infrared detector from plural directions;

a circuit connected to receive said signal output of said infrared detector and connected to provide an overheat signal to said control unit if the output from said infrared detector is above a predetermined level, said circuit connected to monitor the rotation of said optical assembly and output a fault signal to the control unit if rotation is below a preset speed; and a connector for connecting said control unit to said electronic system in said aircraft, wherein said control unit monitors said module for an overheat or fault signal and outputs a fire or fault signal if the condition is verified.

6. The system of claim 5, further comprising a switch attached to said module, said switch outputting an overheat signal to said control unit if the temperature of said switch is above a predetermined level.

7. The system of claim 6, wherein said switch outputs an overheat signal if the temperature of said switch is greater than about 85° C.

8. The system of claim 5, further comprising a remote status display connected to said control unit and located in or near a cargo bay of the aircraft, said remote status display having indicator lamps to signal the presence of a fire.

9. The system of claim 5, wherein said circuit provides an overheat signal to said control unit if the infrared detector indicates a temperature greater than 200° C.

10. The system of claim 5, wherein said thermal imaging module further comprises a motor and a motor control circuit attached to rotate said optical assembly.

11. The system of claim 10, wherein said motor rotates said optical assembly at about one revolution per second.

12. The system of claim 5, wherein said optical assembly further comprises:

a cover attached to said housing, said cover being rotatable with respect to said housing and substantially preventing radiation from passing therethrough, said cover defining an opening which allows infrared radiation to pass to said infrared detector;

a reflector mounted in said cover, said reflector directing radiation entering through said opening to said detector; and a lens for focusing radiation of said infrared detector or said reflector, said lens being mounted in said opening of said cover.

13. The system of claim 12, wherein said lens of said optical assembly provides a field of view approximately 10° by 70°.

14. The system of claim 12, wherein said lens of said optical assembly comprises seven lenses each having a conical field of view of approximately 10°, said lenses having their beam centers spaced radially every 10°.

15. The system of claim 5, wherein said circuit further comprises:

an amplifier connected to the output of said infrared detector to magnify the signal output by said infrared detector;

a threshold circuit connected to the output of said amplifier, said threshold circuit comparing the signal from said amplifier and asserting an output signal if the level of the signal from said amplifier is above a preset level; and an interface multiplexer coupled to said control unit and said threshold circuit, said interface multiplexer controlling the communication between said control unit and said thermal imaging module.

16. The system of claim 15, wherein said amplifier comprises a series connection of a differential amplifier and a high gain amplifier.

17. The system of claim 15, wherein said threshold circuit comprises two counters and a comparator.

18. The system of claim 15, wherein said interface circuit comprises an RC timer, a monostable multivibrator and a transmission gate.

19. The system of claim 5, wherein said thermal imaging module further comprises:

an infrared emitter attached near said infrared detector; and self-test logic coupled to said infrared emitter to provide pulses which cause said infrared emitter to produce infrared radiation equivalent to infrared radiation produced by a fire, said self-test logic also coupled to said control unit which provides a signal to said self-test logic to initiate production of infrared radiation for testing the system.

20. The system of claim 19, wherein said self-test logic comprises a comparator and a pulse generator which output a series of pulses in response to a signal from the control unit.

21. The system of claim 5, wherein said control unit is a microprocessor and memory.

22. An apparatus for detecting an overheat condition comprising:

an infrared detector that outputs a signal corresponding to the level of infrared radiation;

a stationary housing protecting said infrared detector with said infrared detector positioned therein;

a rotating optical assembly attached to said housing for directing infrared radiation to said infrared detector from plural directions; and a circuit connected to receive the output of said infrared detector and to provide an overheat signal if the output from said infrared detector is above a predetermined level; said circuit also connected to monitor the rotation of said optical assembly and to provide a fault signal if said optical assembly rotates at a rate below a preset level.

23. The apparatus of claim 22, further comprising a switch attached to said housing, said switch outputting an overheat signal if the temperature of said switch is above a predetermined level.

24. The apparatus of claim 22, further comprising a motor and a motor control circuit attached to rotate said optical assembly to provide said infrared detector with a substantially conical field of view.

25. The apparatus of claim 24, wherein said motor rotates said optical assembly at about one rotation per second.

26. The apparatus of claim 22, wherein said optical assembly further comprises:

a cover attached to said housing, said cover being rotatable with respect to said housing and substantially preventing radiation from passing therethrough, said cover defining an opening which allows infrared radiation to pass to said infrared detector;

a reflector mounted in said cover, said reflector directing radiation entering through said opening to said detector; and a lens for focusing radiation on said reflector, said lens being mounted in said opening of said cover.

27. The apparatus of claim 26, wherein said lens of said optical assembly provides a field of view approximately 10° by 70°.

28. The apparatus of claim 27, wherein said lens of said optical assembly comprises seven lenses each having a conical field of view of approximately 10°, said lenses having their beam centers spaced radially every 10°.

29. The apparatus of claim 22, wherein said circuit further comprises:

an amplifier connected to the output of said infrared detector to magnify the signal output by the infrared detector;

a threshold circuit connected to the output of said amplifier, said threshold circuit comparing the signal from said amplifier and asserting a signal if the level of the signal from said amplifier is above a preset level; and an interface multiplexer coupled to said control unit and said threshold circuit, said interface multiplexer controlling the communication between said control unit and said thermal imaging module.

30. The apparatus of claim 29, wherein said amplifier is a series connection of a differential amplifier and a high gain amplifier.

31. The apparatus of claim 29, wherein said threshold circuit comprises two counters and a comparator.

32. The apparatus of claim 29, wherein said interface circuit comprises an RC timer, a monostable multivibrator and a transmission gate.

33. The apparatus of claim 22, wherein said thermal imaging module further comprises:

an infrared emitter attached near said infrared detector; and a pulse generator which outputs a series of pulses to test the apparatus, said pulse generator coupled to said infrared emitter to produce infrared radiation equivalent to infrared radiation produced by a fire, said pulse generator responsive to a test signal.

34. A system for use with aircraft electronics to detect the presence of fire in the cargo bay of the aircraft, said system comprising:

a first plurality of thermal imaging modules positioned to view the entire area of the cargo bay, each of said thermal imaging modules measuring infrared radiation in a portion of the cargo bay and outputting an overheat signal if an overheat condition is detected or a fault signal if the module is defective;

a first control unit coupled to the aircraft electronics for receiving test signals and sending fault and fire detect signals, said first control unit also coupled to said first plurality of modules for receiving overheat and fault signals from said modules and sending a test signal to said modules;

a second plurality of thermal imaging modules positioned to view the entire area of the cargo bay, each of said thermal imaging modules measuring infrared radiation in a portion of the cargo bay and outputting an overheat signal if an overheat condition is detected or a fault signal if the module is defective;

a second control unit coupled to the first control unit for receiving test signals, said second control unit coupled to the aircraft electronics for sending fault and fire detect signals, said second control unit also coupled to said second plurality of modules for receiving overheat and fault signals from said modules and sending a test signal to said modules; and wherein each of said modules connected to said first and said second control units comprises:

an infrared detector that outputs a signal corresponding to the level of infrared radiation;

a stationary housing mounted to the aircraft, said stationary housing protecting said infrared detector with infrared detector positioned therein;

an optical assembly attached to said housing for directing infrared radiation toward said infrared detector;

a circuit connected to receive input from said infrared detector and to output an overheat signal if the output from said infrared detector is above a predetermined level; and a switch attached to said module, said switch outputting an overheat signal if the temperature of said switch is above a predetermined level.

35. A system for detecting fire comprising:

a control unit;

a plurality of thermal imaging modules for detecting a fire or overheat condition, said thermal imaging modules further comprising:

an infrared detector;

an optical assembly for directing infrared radiation toward said detector;

a circuit connected to said detector to receive input from said detector and output an overheat signal; and an interface multiplexer connected to said circuit and coupled for communication with said control unit, said interface multiplexer having two data lines and two address lines, said interface multiplexer capable of both inputting and outputting signals on said data and address lines; and wherein said plurality of thermal imaging units are coupled by a daisy chain connection with a data line and an address line between each of said thermal imaging modules, a first thermal imaging module in said chain connected to said control unit and a last thermal imaging module in said chain connected to said control unit, thereby providing bidirectional communication in which any thermal imaging module may communicate with said control unit using either the connection of said first thermal imaging module to said control unit or the connection of said last thermal imaging module to said control unit.

36. A system for detecting fire comprising:

a control unit producing an inquisition signal and receiving data;

a plurality of thermal imaging modules for detecting a fire or overheat condition, said thermal imaging modules further comprising:

an infrared detector;

an optical assembly for directing infrared radiation toward said detector;

a circuit connected to said infrared detector to receive input from said detector and output an overheat signal; and an interface multiplexer connected to said circuit and coupled for communication with said control unit, said interface multiplexer receiving said inquisition signal on an address line, said interface multiplexer outputting data on a data line and said inquisition signal on a second address line after a preset delay in response to said inquisition signal; and wherein said plurality of thermal imaging modules are daisy chain connected with one data line and one address line between each of said thermal imaging modules, a first thermal imaging module in said chain connected to said control unit, thereby defining a series of time slots in which each thermal imaging module may respond to said inquisition signal, said time slots being defined by the amount of delay from the previous thermal imaging modules in the chain.

37. A system for detecting fire comprising:

a control unit;

a plurality of thermal imaging modules for detecting a fire or an overheat condition, said thermal imaging modules further comprising:

an infrared detector;

a rotating optical assembly for directing infrared radiation toward said detector;

a control circuit connected to regulate the rotation rate of said optical assembly, said control circuit outputting a signal indicating a rotation of said optical assembly; and a circuit connected to receive input from said detector and said control circuit, said circuit outputting an overheat signal to said control unit if the output of said detector indicates an overheat condition in a preset number of consecutive rotations of said optical assembly as indicated by the output signal from said control circuit.

38. A method for detecting fire in a cargo bay of an aircraft comprising the steps of:

mounting a control unit in the aircraft;

positioning a plurality of thermal imaging modules having an infrared detector for sensing the presence of fire in the cargo bay to view a substantial portion thereof and not interfere with loading and unloading of the cargo bay;

coupling said control unit to each of said thermal imaging modules;

sensing the presence of an overheat or fire condition with said thermal imaging modules; and signaling an overheat condition with said control unit if any of said thermal imaging modules senses a fire or overheat condition in the cargo bay of the aircraft.

* * * * *

UNITED STATES PATENT AND TRADEMARK OFFICE

CERTIFICATE OF CORRECTION

PATENT NO. : 5,059,953

DATED : October 22, 1991

INVENTOR(S) : Parsons, Hutchins and Tseng

It is certified that error appears in the above-identified patent and that said Letters Patent is hereby corrected as shown below:

Abstract, line 4, change "cargo by for" to --cargo bay for--.

Col. 14, line 22, change "3140" to --31-40--.

Signed and Sealed this

Thirteenth Day of July, 1993

*Attest:*

*Attesting Officer*

Michael K. Kirk

MICHAEL K. KIRK

*Acting Commissioner of Patents and Trademarks*